US005658142A

United States Patent [19]

Kitchen et al.

[11] Patent Number: 5,658,142

[45] Date of Patent: Aug. 19, 1997

[54] MATERIAL DRYING SYSTEM

[75] Inventors: John A. Kitchen; Alan G. Buchkowski, both of Hastings, Canada

[73] Assignee: Novadyne Ltd., Hastings, Canada

[21] Appl. No.: 388,531

[22] Filed: Feb. 14, 1995

[51] Int. Cl.[6] ..... F27B 15/09

[52] U.S. Cl. ..... 432/58; 432/67; 432/68; 432/69

[58] Field of Search ..... 432/25, 58, 67, 432/68, 69, 70, 71, 95, 96

[56] References Cited

U.S. PATENT DOCUMENTS

| | | | |
|---|---|---|---|
| 2,898,978 | 8/1959 | Kitchen . | |
| 2,916,032 | 12/1959 | Kitchen . | |
| 3,005,485 | 10/1961 | Salgo et al. . | |
| 3,267,985 | 8/1966 | Kitchen . | |
| 3,462,955 | 8/1969 | Lockwood . | |
| 3,618,655 | 11/1971 | Lockwood | 159/4 E |
| 4,241,720 | 12/1980 | Kitchen . | |
| 4,309,977 | 1/1982 | Kitchen . | |
| 4,699,588 | 10/1987 | Zinn et al. . | |
| 4,706,390 | 11/1987 | Kitchen . | |
| 4,832,598 | 5/1989 | Kitchen . | |

FOREIGN PATENT DOCUMENTS

| | | |
|---|---|---|
| 2810045 | 9/1979 | Germany . |

*Primary Examiner*—Henry A. Bennett
*Assistant Examiner*—Gregory A. Wilson
*Attorney, Agent, or Firm*—Bereskin & Parr

[57] ABSTRACT

A material drying system includes a pulse combustor having a combustion chamber and an elongate tailpipe forming a resonant system with the combustion chamber. The tailpipe has an inlet for material to be dried and an outlet through which the material is discharged in a pulsating gas stream when the combustor is in operation. The tailpipe discharges into a vertical drying duct which leads to a cyclone separator. Part of the exhaust gas leaving the cyclone separator is recycled and used to cool the combustion chamber and tailpipe. Part of the dried material leaving the cyclone separator can be mixed with new incoming wet material to lower the overall moisture content of the material to be dried. The pulse combustor provides a substantial portion of the motive force required to operate the system.

11 Claims, 2 Drawing Sheets

MATERIAL DRYING SYSTEM

FIELD OF THE INVENTION

This invention relates generally to dryers for fluent materials, and is concerned more particularly with dryers of the type which incorporate a pulsating combustor (or "pulse combustor").

BACKGROUND OF THE INVENTION

Pulsating combustion is a phenomenon which is well known in the art of air and water heating and is quite extensively discussed in the literature. Early examples of prior art pulse combustion apparatus are shown in U.S. Pat. Nos. 2,898,978 (issued to the present inventor—John A. Kitchen) and 3,005,485 (Salgo and Kitchen). Other examples of United States patents that have issued to John A. Kitchen in this field are U.S. Pat. Nos. 2,916,032; 3,267,985; 4,241,720; 4,241,723; and 4,309,977.

Conventional dehydration processes generally involve moving the material through a zone of heated air which is being blown at high velocity. After drying, the material is separated from the air and collected. In conventional flash driers, material being dried is conveyed pneumatically and dried at the same time through a long duct or pipe. This system is particularly advantageous in drying particulate and combustible substances. Air and gas velocities may have to be as high as 5000 ft/min or more in order to transport the material; as such, considerable electrical energy must be expended to drive blowers. This is in addition to the fuel necessary for the heat required for drying.

It has been recognized that the rate of drying can be increased by imposing sound waves on the material in the presence of heated air. Pulsating combustion has been suggested as a method of providing intense sonic waves for dehydration, as well as the required heat and high velocity gas stream.

U.S. Pat. Nos. 4,706,390 and 4,832,598 (both to John A. Kitchen) disclose pulse combustion dehydrators. Other examples are shown in Lockwood's U.S. Pat. Nos. 3,462,955 and 3,618,655. Also of interest are U.S. Pat. No. 4,699,588 (Zinn et al.) and German Offenlegungschrift 28 10 045 (Piterskich et al.).

A pulse combustor consists essentially of a combustion chamber which has one-way air and fuel inlet valves at one end and, at the other end, a tailpipe through which exhaust gases are expelled. This expulsion results from the force of cyclic explosions of an air/fuel mixture. Following each explosion there is a partial vacuum in the combustion chamber which draws in another charge of fuel and air. Exhaust gases are also drawn back into the chamber. Flame fronts in the returning exhaust gases cause ignition of the new charge. Interference with this wave delays or prevents ignition of the new charge and can weaken or completely stop the combustion cycle.

It has been proposed to inject the material to be dried directly into the tailpipe of the pulse combustor in order to maximize the heat and pressure of the exhaust gases on the material. Interference with the combustion cycle is prevented by injecting the material into an enlarged section of pipe where the velocity of the gases provide a low pressure zone (see e.g. the '598 Kitchen patent referred to previously). Material will actually be drawn into the tailpipe at this point without assistance, although a feeding mechanism is usually provided to control the rate of flow.

In existing applications of pulse combustion to drying, the material is discharged from the tailpipe of the pulse combustor into a rotary drum or other large volume where circulating exhaust gases dry the material.

SUMMARY OF THE INVENTION

According to the invention there is provided a material drying system which includes a pulse combustor having a combustion chamber and an elongate tailpipe forming a resonant system with the combustion chamber. The tailpipe has inlet means for fluent material to be dried and an outlet through which the material is discharged in a pulsating exhaust gas stream when the combustor is in operation. Means is provided downstream of the tailpipe outlet for separating dried fluent material from the exhaust gas stream. A drying duct extends between the outlet of the pulse combustor tailpipe and the separating means and the material is discharged into the duct in the exhaust gas stream from the tailpipe. The duct has a cross-sectional area selected so that the fluent material is supported by the gas stream in travelling to the separating means and the duct has a length selected so that the fluent material is at least partly dried prior to being separated from the gas stream in the separating means.

This invention can be contrasted with two prior art systems. The first is a conventional "flash" dryer system. This type of system generally includes a piece of equipment which serves to inject the wet material into a hot air stream. The equipment is commonly referred to as a "slinger", or alternately, a "disintegrator". The function of a slinger or disintegrator is twofold: to create surface area on the wet material to enhance drying, and to disperse the wet materials into the hot air stream (600° to 700° F.). Furthermore, flash dryers almost exclusively rely on electrically driven blowers to provide the motive force for the dryer. In this invention wet materials are fed or drawn into the hot exhaust gas stream (1200° to 1500° F.) in the tailpipe where the force of the high velocity disperses the material and accelerates it, drying it in the process. Furthermore, the pulse combustor contributes substantially to the motive force of the drying system, thus displacing a significant amount of the required electrical energy and permitting a reduction in the size of the main system blower.

The second prior art systems are those drying systems which incorporate pulse combustors attached to rotary drums or other large volumes. In this invention, the drying takes place in a duct, and as such, the material is more directly heated and subjected to the sonic waves that emanate from the pulse combustion cycle. Accordingly, it is believed that the drying process will be more efficient and lower in capital cost.

Preferably, means is provided for cooling the combustion chamber and tailpipe so as to prevent damage to those parts and to the fluent material due to overheating. Cooling may be accomplished by recirculating exhaust gas and water vapour which has been separated from the fluent material in the separating means. Alternatively, ambient air may be used to cool the combustion chamber and tailpipe.

Preferably, the drying duct extends vertically over at least a portion of its length. For most fluent materials, this will result in a velocity differential between the exhaust gases and the (heavier) fluent material, which it is believed will assist in the drying process.

Provision may be made for in effect recirculating part of the dried material from the separating means by mixing the dried material with new wet material before it is introduced into the tailpipe of the pulse combustor. By recirculating some of the material in this way, the moisture content of the material as a whole is lowered and the tendency for sticky material to adhere to the duct is reduced.

BRIEF DESCRIPTION OF DRAWINGS

In order that the invention may be more clearly understood, reference will now be made to the accompanying drawings which illustrate two preferred embodiments of the invention by way of example, and in which.

DESCRIPTION OF PREFERRED EMBODIMENTS

Figure 1:
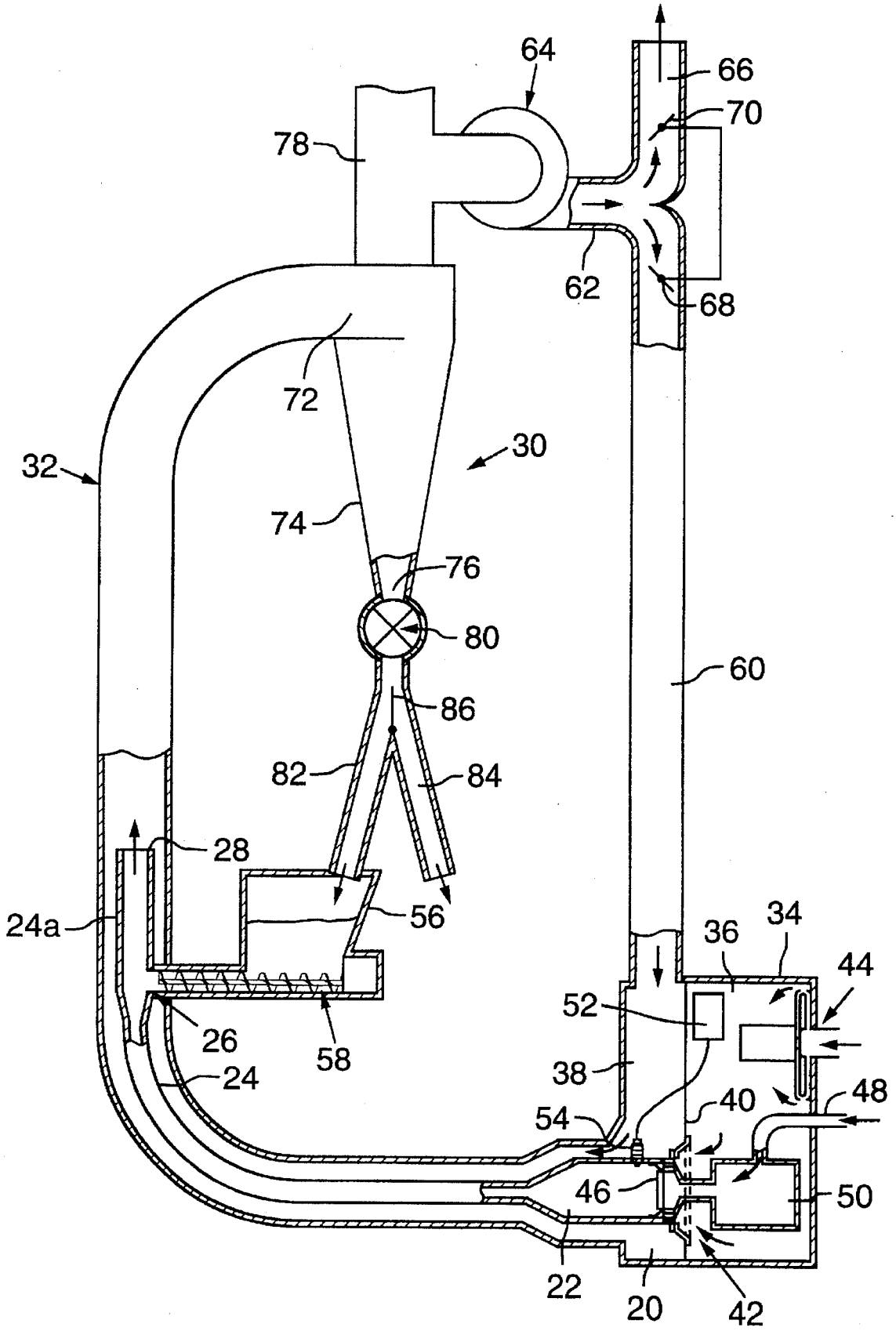
FIGS. 1 and 2 are diagrammatic general arrangement drawings showing two embodiments of material drying systems in accordance with the invention.

Referring first to FIG. 1, a material drying system is shown to include a pulse combustor 20 having a combustion chamber 22 and an elongate tailpipe 24 forming a resonant system with the combustion chamber. The tailpipe has an inlet 26 for fluent material to be dried, and an outlet 28 through which the material is discharged in a pulsating exhaust stream when the combustor is in operation.

The system also includes means for separating dried fluent material from the exhaust gas stream. In this case, the separating means takes the form of a cyclone separator, which is indicated by reference numeral 30. A drying duct 32 extends between the outlet 28 of the pulse combustor tailpipe 24 and the cyclone separator 30. In operation, the fluent material is fed into the tailpipe with the combustor operating, and is discharged in the exhaust gas stream from the tailpipe, into duct 32. The internal diameter of the duct and its length are selected depending on the particular material to be dried and the capacity of the pulse combustor and consequent gas velocity within the duct. The cross-sectional area of the duct should be selected so that the fluent material is supported by the gas stream as it travels to the separating means. At the same time, the length of the duct should be chosen to ensure that the fluent material is at least partly dried by the time it arrives at the cyclone separator. It is believed that the ratio of the length to the square root of the cross-sectional area of the duct should be greater than 10:1.

In the arrangement of FIG. 1, some of the exhaust gases are recycled and used to cool the combustion chamber and tailpipe of the pulse combustor. Heat transferred to these gases from the combustion process then provides additional heat to the material being dried as the gases enter the drying duct. This increases the efficiency of the system overall, by reducing the amount of fresh air taken into the system. As the drying is done by exhaust gases, rather than by air, flammable material may be dried with virtually no risk of fire.

In more detail, pulse combustor 20 is housed in a cabinet 34 which has two internal compartments, denoted 36 and 38 respectively, separated by a partition 40. Combustion chamber 22 is mounted to partition 40 within compartment 38, via an air inlet valve assembly 42 which communicates with compartment 36. A blower 44 is provided in compartment 36 for bringing in ambient air for combustion. Fuel is delivered to combustion chamber 22 through a fuel inlet valve assembly 46 from an inlet line 48, via a cushion chamber 50. A transformer 52 provides a high voltage ignition supply for a spark plug 54 within combustion chamber 22. The spark plug is necessary only during start-up. Once combustion has been proven, the spark plug is switched off.

The pulse combustor has not been described in great detail because its construction is essentially conventional and does not form part of the present invention. Reference may be made to one or more of the Kitchen patents identified previously for specific details of the pulse combustor itself. The disclosures of those patents are incorporated herein by reference.

It will be seen that the tailpipe 24 of the pulse combustor 20 extends generally horizontally from the pulse combustor and then curves upwardly about a relatively large radius, before terminating in a vertically upwardly directed end portion, generally denoted **24*a* in FIG. 1. This end portion is of enlarged diameter compared with the remainder of the tailpipe. Material to be dried is fed into this enlarged end portion of the tailpipe from a hopper 56 by means of an auger 58**. The speed of the auger can be controlled automatically, for example, according to the weight of the material leaving the dryer or the temperature of the drying gases in the system.

At the terminal of the tailpipe 28, the shroud 14 which conducts the tailpipe cooling gases, may be enlarged to reduce the flow restriction to the gas stream and to promote induced flow of the cooling air.

The drier duct 32 extends vertically upwardly from the enlarged end portion of the tailpipe 24 and then itself curves into the cyclone separator 30. Upstream of the outlet 28 from the tailpipe, duct 14 is continued as a shroud or cooling duct around the tailpipe 24, terminating at compartment 38 of cabinet 34. Preferably, the internal diameter of the shroud is more than twice the internal diameter of the enlarged section of the tailpipe. Upstream of compartment 38 is a further duct 60 which extends to a discharge duct 62 from a blower 64. Duct 62 also discharges into an exhaust duct 66. Adjustable dampers 68 and 70 are provided in the respective ducts 60 and 66.

The cyclone separator 30 is essentially a conventional unit and has a material inlet 72 which extends generally tangentially with respect to a longitudinal axis of the separator, and to which the drier duct 32 is coupled. The separator has a main cyclone chamber 74 with a solid material outlet 76 at its lower end and a gas outlet 78 at its upper end. The gas outlet communicates with the inlet of blower 64.

A rotary valve 80 is provided in association with the solid material outlet 76 from the cyclone chamber. Valve 80 is a conventional type of valve (sometimes called a "star" valve) that is designed to allow discharge of solid material, with a minimum of gas. A bifurcated spout having limbs 82 and 84 communicates with the outlet of the rotary valve 80, and is provided with a diverter 86 that can be adjusted to deflect solid material into either limb of the spout as required by the particular operating parameters of the system.

The system is started in accordance with normal pulse combustor operating practice, by first pressurizing compartment 36 of cabinet 34 with combustion air, by operating blower 44. As the air begins to flow through the combustion chamber 22 by way of the air inlet assembly 42, fuel is drawn into the combustion chamber from cushion chamber 50 and the air/fuel mixture is ignited by means of spark plug 54.

Material to be dried is then fed into the enlarged end section **24*a* of the tailpipe 24. The material is discharged from the tailpipe outlet 28 in a pulsating exhaust gas stream and flows upwardly in duct 32 towards the inlet of the cyclone separator 30. The solid material will normally travel at lower velocity than the gas, which tends to accelerate heat transfer from the gas to the material. In the cyclone separator, the solid material will settle towards outlet 76, while the gas will leave through outlet 78 and flow to the inlet of blower 64**.

The diverter blade 86 in the outlet from the cyclone separator may be adjusted to direct part of the flow of dried material back to mix with the wet material in hopper 56. By recirculating some of the material in this way, the moisture content of the processed material overall is lowered and the tendency for sticky material to adhere to the duct is reduced. In other cases, the blade may remain in the position in which it is shown, so that all of the dried material is discharged through outlet 84, and collected.

Exhaust gases (which have now cooled) are drawn from the cyclone separator 30 by blower 64 and blown down duct 60 to cool the combustion chamber 22 and tailpipe 24. Surplus exhaust gases and steam are expelled through outlet 66, past damper 70 and are directed to conventional exhaust clean-up systems, such as bag houses and the like. Dampers 68 and 70 are adjusted to control the flow and pressure of the gases through the drying system.

The recirculated exhaust gases are heated as they travel over the hot surfaces of the combustion chamber and tailpipe. As these gases pass the tailpipe outlet 28, the blast from the tailpipe accelerates the gases as well as the material that has been fed into the tailpipe from hopper 56.

Figure 2:
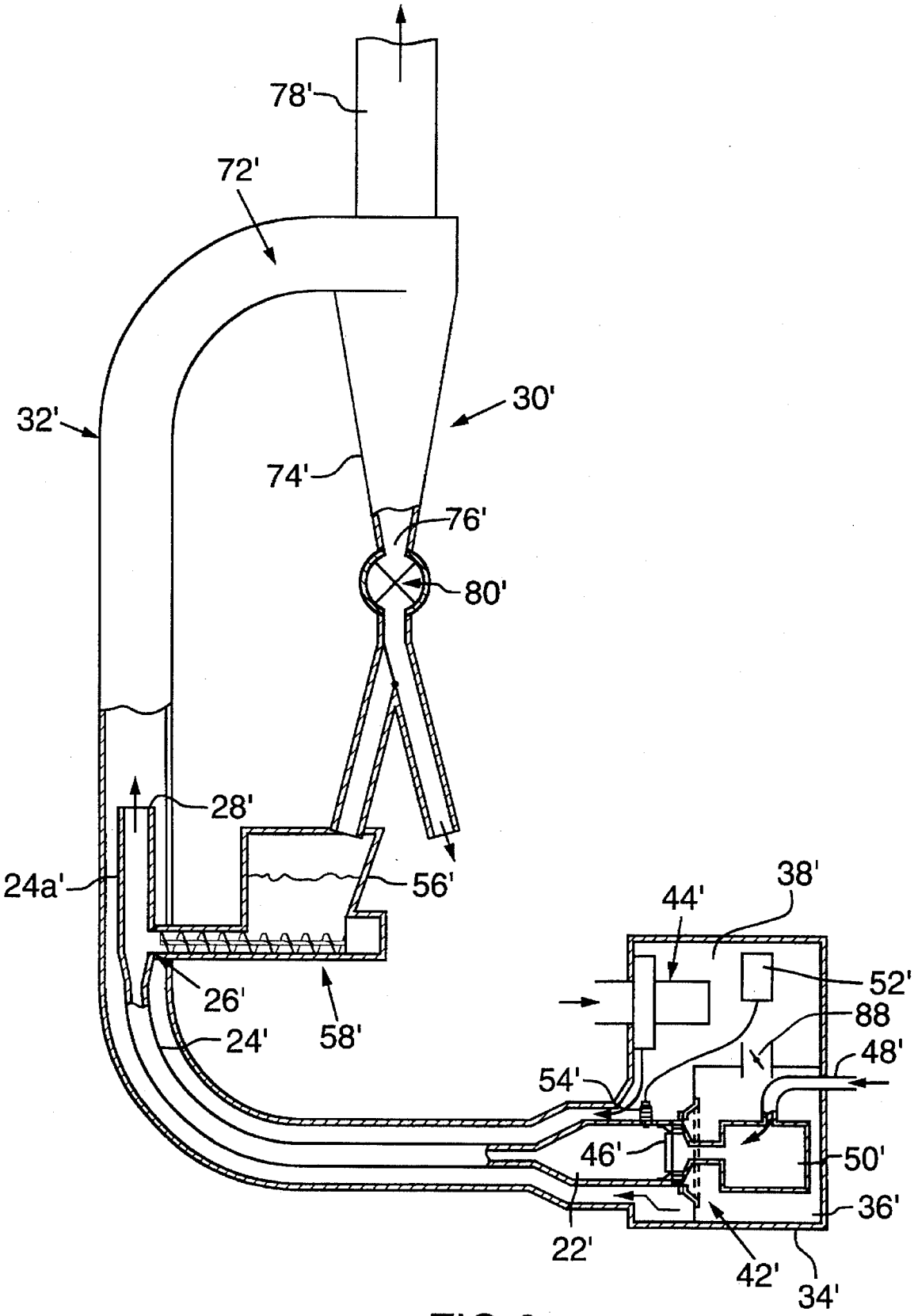

FIG. 2 shows an arrangement which is essentially very similar to the arrangement shown in FIG. 1, except that the exhaust gases are not recirculated from the cyclone separator. Primed reference numerals have been used in FIG. 2 to denote parts that correspond with parts shown in FIG. 1.

In the arrangement shown in FIG. 2, part of the ambient air that is brought into cabinet 34' by blower 44' is diverted into the upstream end of the drier duct 32'. In other words, the blower supplies both combustion air and cooling air. A butterfly valve 88 is used to adjust the flow of combustion air to the air inlet valve assembly of the pulse combustor.

The only other substantive difference in the arrangement of FIG. 2 as compared with FIG. 1 is that gases leaving the cyclone separator are directed straight to exhaust, via a blower (not shown) and there is no recirculation as through duct 60 in FIG. 1.

It should of course be noted that preceding description relates to particular preferred embodiments of the invention and that many modifications are possible within the broad scope of the invention. For example, the particular form of pulse combustor may vary, and means other than a cyclone separator may be used to separate the dried material from the exhaust gases. Also, while it is believed desirable for the pulse combustor to discharge upwardly into a vertical drier duct, this is not essential; for example, the duct could be horizontal.

We claim:

1. A material drying system comprising:

a pulse combustor including a combustion chamber and an elongate tailpipe forming a resonant system with the combustion chamber, the tailpipe having inlet means for fluent material to be dried and an outlet through which the material is discharged in a pulsating exhaust gas stream when the combustor is in operation;

a shroud extending around said combustion chamber and tailpipe, and means for causing a cooling gas to flow along said shroud, for cooling the combustion chamber and tailpipe;

means downstream of the tailpipe outlet for separating dried fluent material from the exhaust gas stream; and, a drying duct extending between the outlet of the pulse combustor tailpipe and said separating means and into which the material is discharged in said exhaust gas stream from said tailpipe, the duct having a cross-sectional area selected so that the fluent material is supported by the gas stream in travelling to the separating means, and the duct having a length selected so that the fluent material is at least partly dried prior to being separated from the gas stream in said separating means.

2. A system as claimed in claim 1, wherein the drying duct extends in an least generally vertical orientation, upwardly from the outlet of the pulse combustor tailpipe towards said separating means.

3. A system as claimed in claim 1, wherein said shroud is formed by a continuation of said drying duct extending upstream from said outlet of the pulse combustor tailpipe.

4. A system as claimed in claim 1, further comprising means for recirculating exhaust gas from said exhaust gas stream leaving the separating means, to said shroud, for cooling the combustion chamber and tailpipe.

5. A system as claimed in claim 4, wherein said means for recirculating said exhaust gas comprises a further duct extending from said separating means to said pulse combustor, said separating means being disposed in an overhead position with respect to the pulse combustor and said drying duct extending in an at least generally vertical orientation upwardly from the outlet of the pulse combustor tailpipe towards the separating means.

6. A system as claimed in claim 3, wherein said pulse combustor is housed in a divided cabinet having first aria second compartments, one of which communicates with said shroud and has an inlet for cooling gas, and the other of which communicates with said combustion chamber and includes an inlet for ambient combustion air.

7. A material drying system comprising:

a pulse combustor including a combustion chamber and an elongate tailpipe forming a resonant system with the combustion chamber, the tailpipe having inlet means for fluent material to be dried and an outlet through which the material is discharged in a pulsating exhaust gas stream when the combustor is in operation;

means downstream of the tailpipe outlet for separating dried fluent material from the exhaust gas stream; and, a drying duct extending between the outlet of the pulse combustor tailpipe and said separating means and into which the material is discharged in said exhaust gas stream from said tailpipe, the duct having a cross-sectional area selected so that the fluent material is supported by the gas stream in travelling to the separating means, and the duct having a length selected so that the fluent material is at least partly dried prior to being separated from the gas stream in said separating means;

wherein said tailpipe has an enlarged section adjacent its said outlet, at which said fluent material inlet means is located, and wherein the system further comprises means for feeding wet fluent material into said inlet means, comprising a hopper for said material, and an auger for feeding material from the hopper to the tailpipe.

8. A system as claimed in claim 7, wherein said separating means has an outlet for dried material, and means for diverting part of the dried material leaving the separating means, into said hopper for mixing with new wet material to be delivered to said tailpipe for drying.

9. A material drying system comprising:

a pulse combustor including a combustion chamber and an elongate tailpipe forming a resonant system with the combustion chamber, the tailpipe having inlet means for fluent material to be dried and an outlet through which the material is discharged in a pulsating exhaust gas stream when the combustor is in operation;

means downstream of the tailpipe outlet for separating dried fluent material from the exhaust gas stream, comprising a cyclone separator having a cyclone chamber with an outlet for dried material at its lower end, and a gas outlet at its upper end; and, a drying duct extending between the outlet of the pulse combustor tailpipe and said separating means and into which the material is discharged in said exhaust gas stream from said tailpipe, the duct having a cross-sectional area selected so that the fluent material is supported by the gas stream in travelling to the separating means, and the duct having a length selected so that the fluent material is at least partly dried prior to being separated from the gas stream in said separating means.

10. A system as claimed in claim 9, wherein said gas outlet is provided with a blower capable of causing gas flow along said drying duct.

11. In a material drying system comprising:

a pulse combustor including a combustion chamber and an elongate tailpipe forming a resonant system with the combustion chamber and through which exhaust gases are expelled in a pulsating exhaust gas stream when the combustor is in operation;

means for introducing into said pulsating exhaust gas stream, fluent material to be dried;

means downstream of the tailpipe for separating dried fluent material from the exhaust gas stream; and, a shroud extending around said combustion chamber and tailpipe, and means for causing a cooling gas to flow along said shroud, for cooling the combustion chamber and tailpipe;

the improvement comprising a drying duct extending between the pulse combustor tailpipe and said separating means and into which the material is discharged in said exhaust gas stream from said tailpipe, the duct having a cross-sectional area selected so that the fluent material is supported by the gas stream in travelling to the separating means, and the duct having a length selected so that the fluent material is at least partly dried prior to being separated from the gas stream in said separating means.

* * * * *